US005964051A

United States Patent [19]

Loeber et al.

[11] Patent Number: 5,964,051

[45] Date of Patent: Oct. 12, 1999

[54] INTERNALLY ILLUMINATED SIGN

[75] Inventors: Charles A. Loeber, Beachhurst; Jack H. Pearlman, Hewlett; Michael Lax, Oyster Bay Cove, all of N.Y.

[73] Assignees: Autronics Plastics, Inc., Westbury; ATlite Lighting Equipment Inc., Maspeth, both of N.Y.

[21] Appl. No.: 08/810,521

[22] Filed: Mar. 3, 1997

[51] Int. Cl.[6] ..... G09F 13/04

[52] U.S. Cl. ..... 40/570; 40/580; 40/581; 362/250; 362/812

[58] Field of Search ..... 40/570, 572, 580, 40/581; 362/800, 812, 250; 411/508

[56] References Cited

U.S. PATENT DOCUMENTS

| | | | |
|---|---|---|---|
| 1,395,491 | 11/1921 | Grannis . | |
| 1,449,444 | 3/1923 | Purvis et al. . | |
| 1,524,446 | 1/1925 | Meacher . | |
| 1,652,477 | 12/1927 | Hall | 40/580 |
| 1,944,276 | 1/1934 | Schepmoes . | |
| 3,309,806 | 3/1967 | Gallagher . | |
| 3,310,670 | 3/1967 | Sheppard . | |
| 3,324,290 | 6/1967 | Lasker . | |
| 3,402,494 | 9/1968 | Gray . | |
| 3,957,351 | 5/1976 | Stockwell . | |
| 4,059,916 | 11/1977 | Tachihara et al. . | |
| 4,180,934 | 1/1980 | Cohen | 40/580 |
| 4,477,394 | 10/1984 | Armstrong et al. | 411/508 X |
| 4,561,203 | 12/1985 | MacDonold, Jr. et al. | 40/572 X |
| 4,768,300 | 9/1988 | Rutilli . | |
| 4,987,639 | 1/1991 | Baiuley et al. | 411/508 X |
| 5,018,290 | 5/1991 | Kozek et al. | 362/812 X |
| 5,105,568 | 4/1992 | Branning . | |
| 5,136,483 | 8/1992 | Schoniger et al. . | |
| 5,151,679 | 9/1992 | Dimmick . | |
| 5,299,109 | 3/1994 | Grondal | 40/570 X |
| 5,365,411 | 11/1994 | Rycroft et al. . | |
| 5,388,035 | 2/1995 | Bodem, Jr. | 362/800 X |
| 5,388,357 | 2/1995 | Malita . | |
| 5,410,453 | 4/1995 | Ruskouski . | |
| 5,412,552 | 5/1995 | Fernandes | 362/250 |
| 5,416,679 | 5/1995 | Ruskouski et al. | 362/250 X |
| 5,428,912 | 7/1995 | Grondal et al. . | |
| 5,459,955 | 10/1995 | Ruskouski et al. | 40/570 |
| 5,461,550 | 10/1995 | Johnstone | 362/812 X |
| 5,526,251 | 6/1996 | Andre et al. | 362/812 X |
| 5,539,623 | 7/1996 | Gurz et al. | 40/570 X |
| 5,542,201 | 8/1996 | Grondal et al. . | |
| 5,640,792 | 6/1997 | Smith et al. | 40/570 X |
| 5,656,925 | 8/1997 | Schie et al. . | |

FOREIGN PATENT DOCUMENTS

| | | | |
|---|---|---|---|
| 2047830 | 4/1992 | Canada | 40/570 |
| 1105443 | 12/1955 | France . | |
| 234306 | 9/1990 | Japan | 40/570 |
| 22990 | 7/1914 | United Kingdom . | |
| 2168519 | 6/1986 | United Kingdom . | |

*Primary Examiner*—Blair M. Johnson
*Attorney, Agent, or Firm*—Ostrolenk, Faber, Gerb & Soffen, LLP

[57] ABSTRACT

An emergency sign includes a body having a top, two spaced apart sides, and a bottom defining a cavity, a front cover having an inside surface and cut out portions extending through the cover forming indica, a light source disposed within the cavity, and a diffuser coupled to the cover and covering the indicia, the diffuser having cut away portions for permitting light from the light source to reflect off of the inside surface of the front cover. The diffuser may include pigment therein, which pigment is color matched to correspond to the wavelength of the light from the light source. The light source may include an array of LEDs where some of the LEDs are of a diffused type and some of the LEDs are of a unidirectional type.

60 Claims, 9 Drawing Sheets

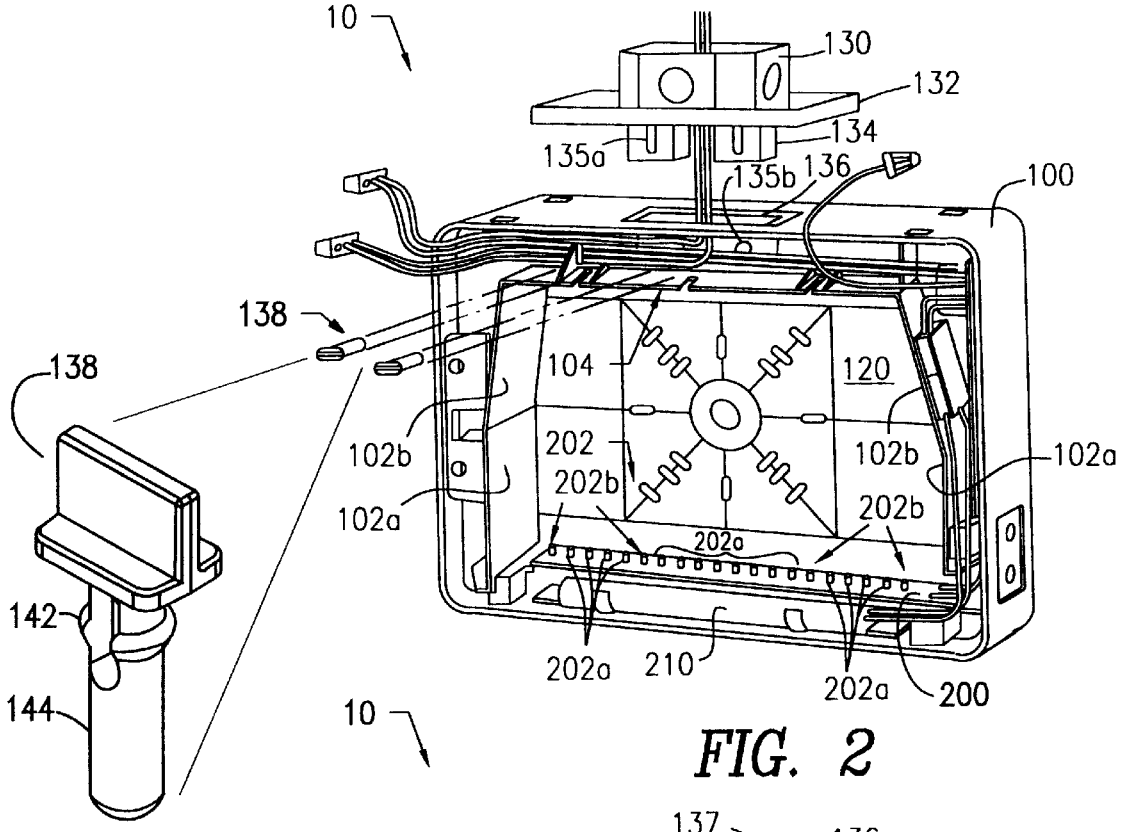
FIG. 2
FIG. 2a
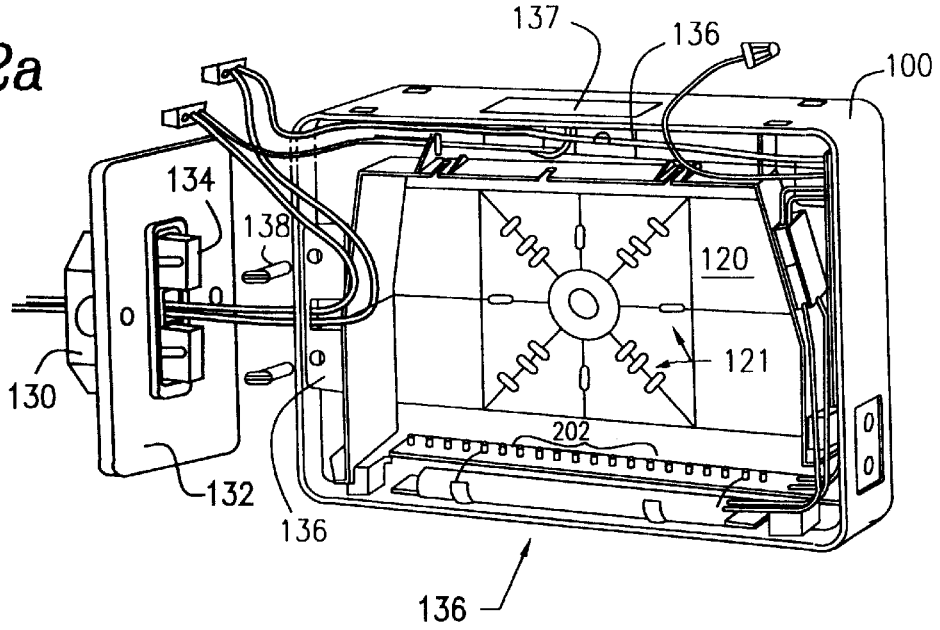
FIG. 3

INTERNALLY ILLUMINATED SIGN

BACKGROUND OF THE INVENTION

1. Field of the Invention

The present invention relates to internally illuminated signs and, more particularly, to internally illuminated emergency signs using light emitting diodes as light sources therein.

2. Related Art

In the illuminated sign industry, particularly the emergency sign industry, it is important to provide a relatively small illuminated sign which exhibits evenly illuminated indicia while using as little energy as possible. In keeping, it is desirable to internally illuminate the sign using an efficient light source.

Internally illuminated signs, particularly Exit signs, are known in the art. For example, U.S. Pat. No. 5,542,201 shows an internally illuminated sign having a unidirectional light emitting diode (LED) array as a light source. The sign of the '201 Patent includes a housing having a top, a bottom, two sides, a front and a back where the LED array is disposed along a side of the housing. In an attempt to meet the needs of the art, the sign of the '201 patent, utilizing the unidirectional LED array, requires a special reflector for diffusing and directing the unidirectional light from the array out the front of the sign.

There is also a disadvantage in mounting the LED array to the side wall of a housing in an internally illuminated sign. Indeed, when the LED array is positioned on a side wall of a housing (as in the '201 patent) the additional reflector plate must include a special upturned section to direct light from the source out the indicia of the sign. The upturned section of the reflector is required because the single LED array is unduly far from the opposite side of the housing which also requires light.

Accordingly, there is a need in the art for a simple, cost effective, power efficient, and internally illuminated sign which utilizes a low energy but high intensity light source, for example an LED array, yet also evenly illuminates the indicia of the sign.

Internally illuminated signs of the prior art utilize an opaque cover having cut out portions forming indicia therein (sometimes called a stencil) to permit light to escape from within the sign an attract the eye of a viewer. When LED arrays are used to illuminate the sign, diffusers (as opposed to "fibers" which are used with incandescent light sources) are placed over the cut out portions to more evenly distribute the light emitting from the sign and mitigate hot spots.

The diffusers are typically formed from a solid extruded piece of transparent acrylic material which has been coated on one or both sides with red paint. Unfortunately, the steps required in the painting process adds manufacturing costs to the final product and often does not result in maximized diffusion and/or minimized attenuation of light. Accordingly, there is a need in the art for an improved diffuser which maximizes diffusion of light, minimizes attenuation of light and reduces the manufacturing costs of the sign.

In some States (for example Colorado and California), government requirements mandate that the illuminated indicia of an Exit sign be green. Such requirements are becoming increasingly popular. Unfortunately, commercially viable, high intensity, green LEDs are typically unidirectional and, therefore, there is a need in the art for a cost effective, efficient, and internally illuminated exit sign having evenly illuminated green indicia.

Also of import in the emergency sign industry, particularly the exit sign industry, is that an exit sign provide emergency battery backup power while meeting or exceeding the Underwriter Laboratories (UL) 924 Standard. Unfortunately, signs of the prior art either do not provide battery backup power or do not do so most efficiently and most cost effectively. Accordingly, there is a need in the art for an improved internally illuminated sign which meets UL 924 while maintaining low manufacturing costs and efficient power handling.

Further, it is important in the emergency sign industry that a sign provide emergency incandescent lighting. Unfortunately, prior art signs do not employ incandescent lighting units which are integral with an emergency sign, for example, an Exit sign. Accordingly, there is a need in the art for an Exit sign which employs an integrally mounted incandescent lighting unit which provides directionally adjustable incandescent lighting in emergencies.

Still further, designers of emergency signs have searched for a commercially viable method of mounting emergency signs, which method provides a customer with options as to whether the sign is to be top mounted, bottom mounted or side mounted to a wall, ceiling or the like. Unfortunately, prior art emergency signs do not provide such a commercially viable method. Accordingly, there is a need in the art for a new method of mounting emergency signs, which method provides a customer with optional top, bottom or side mounting of the sign.

SUMMARY OF THE INVENTION

In order to overcome the disadvantages of prior art internally illuminated signs, according to one aspect the present invention an emergency sign includes a body having a top, two spaced apart sides, and a bottom defining a cavity, a front cover having an inside surface and cut out portions extending through the cover forming indica, a light source disposed within the cavity, and a diffuser coupled to the cover and covering the indicia, the diffuser having cut away portions for permitting light from the light source to reflect off of the inside surface of the front cover.

According to another aspect of the present invention, the diffuser further includes pigment therein, which pigment is color matched to correspond to the wavelength of the light from the light source.

According to still another aspect of the present invention the light source disposed within the cavity includes an array of unidirectional LEDs and an array diffuser coupled to the light source to diffuse the unidirectional light of the LEDs.

According to still another aspect of the present invention, at least one of the LEDs is a diffused type LED and at least one of the LEDs is a unidirectional type LED.

According to still another aspect of the present invention, the internally illuminated sign further includes an emergency lighting unit integrally coupled to the body, the lighting unit including at least one adjustable incandescent light source for illuminating an area around the sign.

According to still another aspect of the present invention, the internally illuminated sign further includes a canopy receptacle disposed in the body, a canopy including a base coupled to a junction box and at least one extension portion stretching away from the base which operatively engages the canopy receptacle such that the sign is fixed to the box.

Other features and advantages of the present invention will become apparent from the following description of the invention which refers to the accompanying drawings.

BRIEF DESCRIPTION OF THE DRAWINGS

For the purpose of illustrating the invention, there is shown in the drawing forms which are presently preferred, it being understood, however, that the invention is not limited to the precise arrangements and instrumentalities shown.

FIG. 2 shows a partially exploded perspective view of the internally illuminated sign of FIG. 1 with the front cover removed;

FIG. 2*a* shows an enlarged perspective view of a coupling nail in accordance with the preferred embodiment of the present invention;

FIG. 3 shows a partially exploded perspective view of a variation on the internally illuminated sign of FIG. 2;

DETAILED DESCRIPTION OF THE INVENTION

Figure 1:
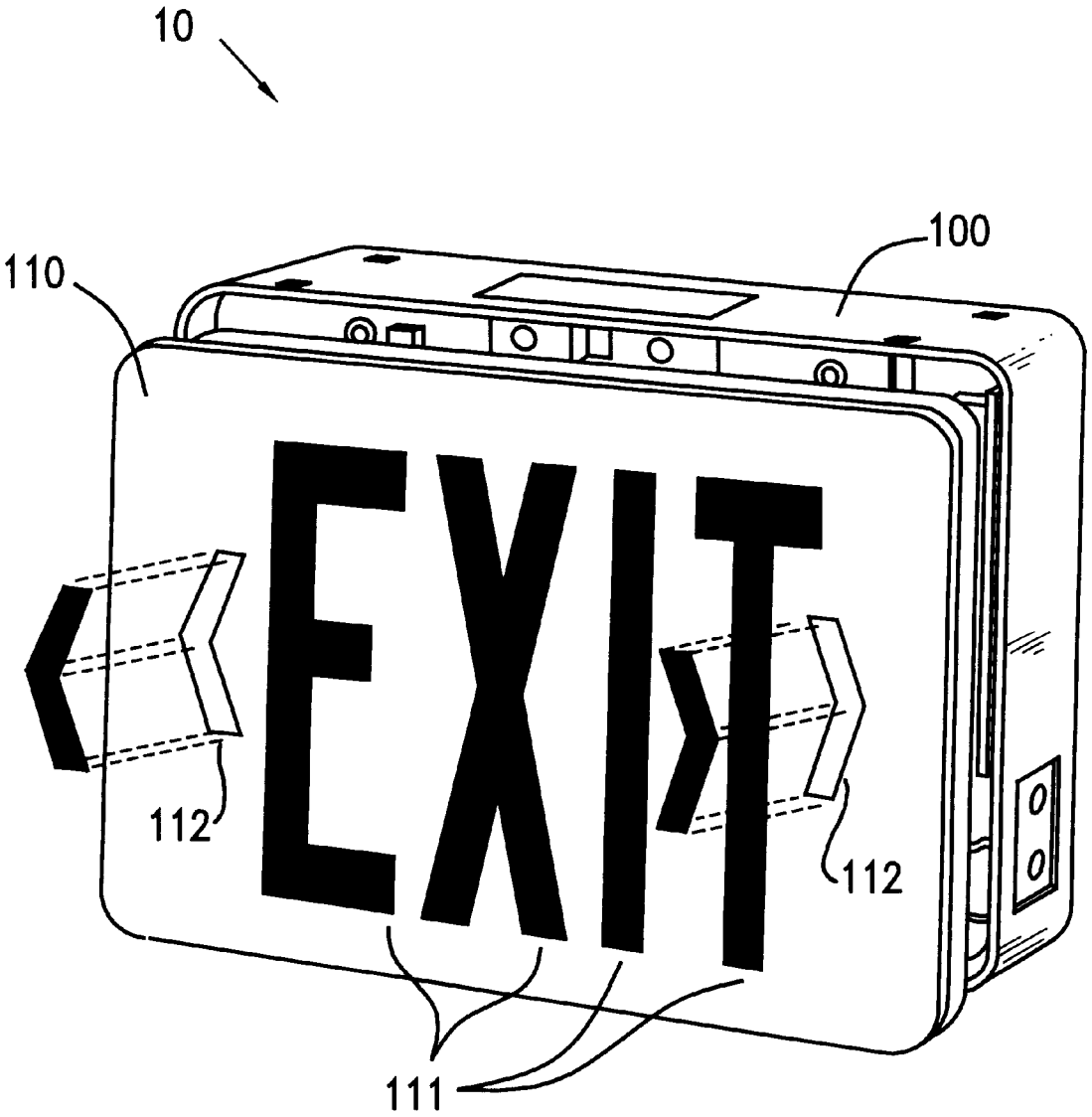
FIG. 1 shows a partially exploded perspective view of one embodiment of the internally illuminated sign of the present invention.

Referring now to the drawings wherein like numerals indicate like elements, there is shown in FIG. 1 an internally illuminated sign 10 according to a first embodiment of the present invention. The sign 10 includes a body 100 and a removable front cover 110 both preferably formed of industrial grade moldable plastic. The front cover 110 includes stenciled indicia 111 in the form of cut out regions which preferably spell out the word "EXIT." In addition, chevrons 112 are disposed in the front cover 110 and may be optionally used by removing respective cut outs. As is evident from FIG. 1, the sign 10 has an attractive profile and a relatively small footprint.

Referring to FIG. 2 the internally illuminated sign 10 is shown with the front cover 110 removed. As shown, the inside of the body 100 includes a top wall 104 and side walls, generally designated 102. Each side wall includes a substantially vertically extending portion 102*a* and a substantially obliquely extending portion 102*b*. The oblique portions 102*b* are also referred to as "jots" in the art.

A printed circuit board (PCB) 200 extends along the bottom of the body 100 in a substantially perpendicular orientation to the front and back covers 110, 120. A line array of LEDs, generally designated 202, are disposed on the PCB 200 in a perpendicular orientation to the plane of the PCB 200, where each LED has a generally uniform spacing therebetween.

The sign 10 is mounted to the structure of a building by way of a canopy system. The system includes a canopy 132, a canopy receptacle 136 disposed in the top portion of the body 100, and canopy nails 138. The canopy 132 includes a substantially flat base portion and pair of extension portions 134 stretching away therefrom. Each extension portion 134 includes a nail hole 135*a* therein which cooperates with a corresponding nail hole 135*b* in the canopy receptacle 136. With reference to FIG. 2*a*, each nail 138 includes a grip 140 integrally coupled to a shaft 144 where the shaft includes a detent ring 142 for operatively engaging the holes 135*a* and 135*b* of the extension portions 134 and canopy receptacle 136 respectively.

The sign 10 is mounted by first coupling the canopy 132 to a standard junction box 130. Next, the sign 10 is moved toward the canopy 132 such that the extension portions 134 of the canopy 132 engage the canopy receptacle 136 of the body 100. Finally, the nail holes 135*a*, 135*b* are aligned and the nails 138 are inserted therein such that the body is fixed to the canopy 132.

Figure 7:
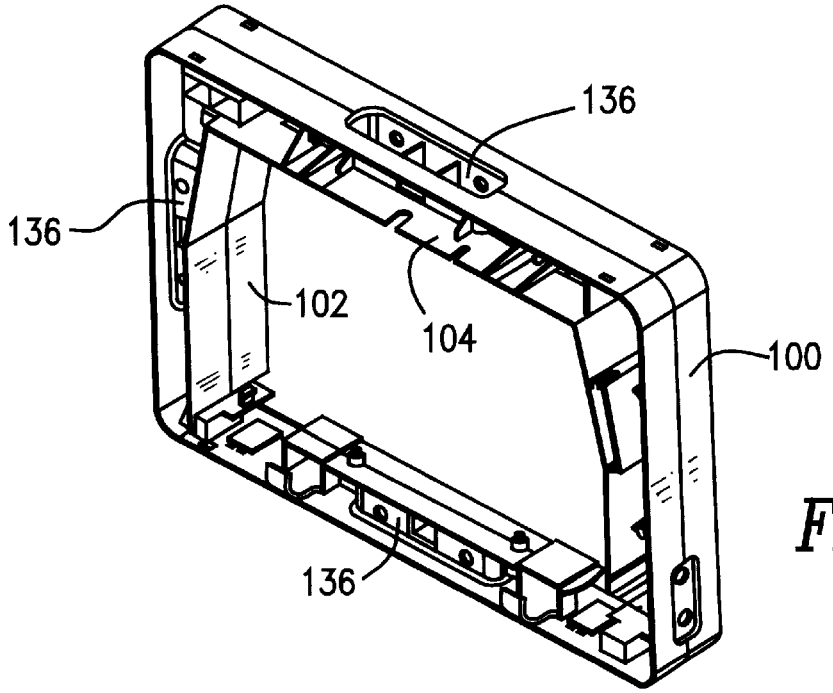
FIG. 7 shows a perspective view of the housing of the internally illuminated sign in accordance with the preferred embodiment of the present invention.

With reference to FIGS. 3 and 7, the body 100 advantageously includes a canopy receptacle 136 on the top, side and bottom of the body 100. Therefore, the sign 10 may be top, side or bottom mounted as desired by the user. When a particular canopy receptacle 136 is not in use, the receptacle is sealed with a cover 137 (FIG. 3).

It is noted that the rear cover 120 is also removable from the body 100 and includes universal mounting knockouts 121 which may be used if the sign 10 is to be rear mounted (FIG. 3). Further, if a user desires the sign to have indicia 111 on both the front and back covers 110, 120, the rear cover 120 may be removed and discarded in favor of a cover having indicia 111 thereon.

Figure 4:
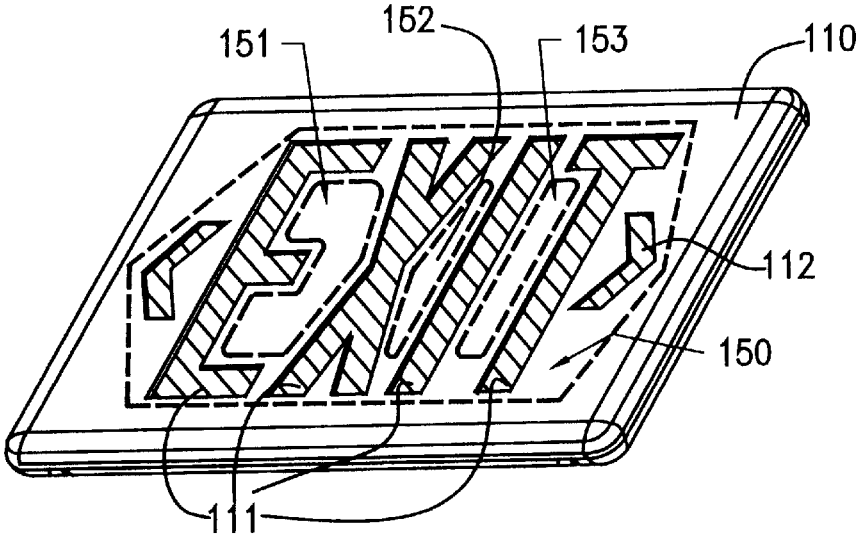
FIG. 4 shows a perspective view of the front cover of the internally illuminated sign in accordance with the preferred embodiment of the present invention.
Figure 5:
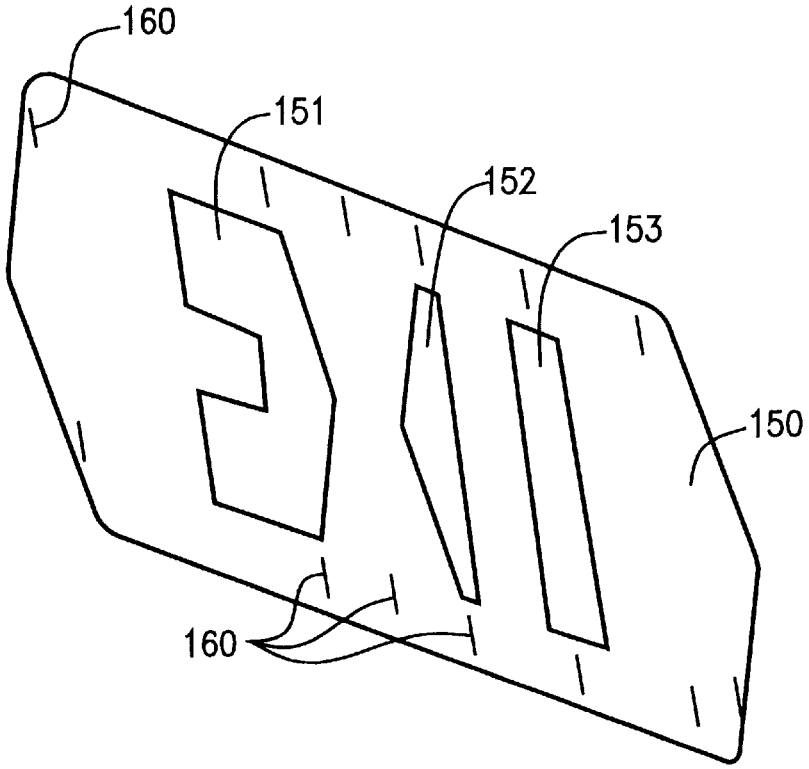
FIG. 5 shows a perspective view of the diffuser of the internally illuminated sign in accordance with the preferred embodiment of the present invention.
Figure 6:
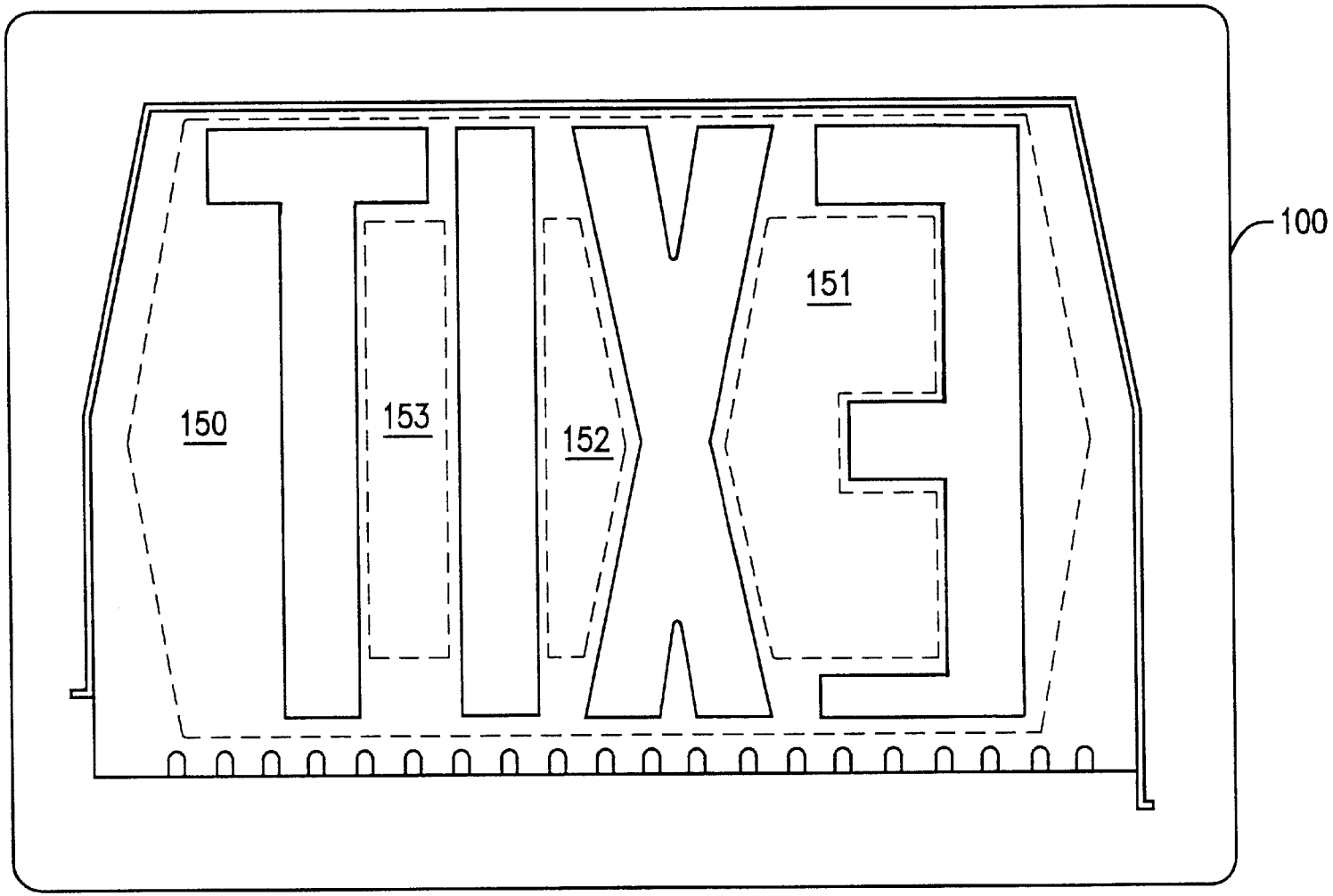
FIG. 6 shows a rear elevational view of the internally illuminated sign of FIG. 1 with the back cover removed.

Reference is now made to FIGS. 4–6 which provide various views of the front cover 110 and diffuser 150 in accordance with the preferred embodiment of the present invention. Specifically, with reference to FIG. 5, the diffuser 150 of the present invention is shown in perspective. Unlike the diffusers of the prior art, the diffuser 150 of the present invention is formed of an injection molded pigmented plastic material.

It has been found that the diffusion and attenuation of the light emanating from the sign 10 is affected by the density and color of the pigment introduced into the plastic material before molding. In particular, it has been found that by matching the color of the plastic material to the wavelength of the light from the LED array 202, the attenuation of light through the diffuser 150 is minimized for a given amount of pigment. Thus, when LEDs of the red diffused type 202*a* are used in the array 202, the LEDs have a wavelength of about 660 nm at peak emission and the pigment of the diffuser 150 is color matched thereto.

Figure 11:
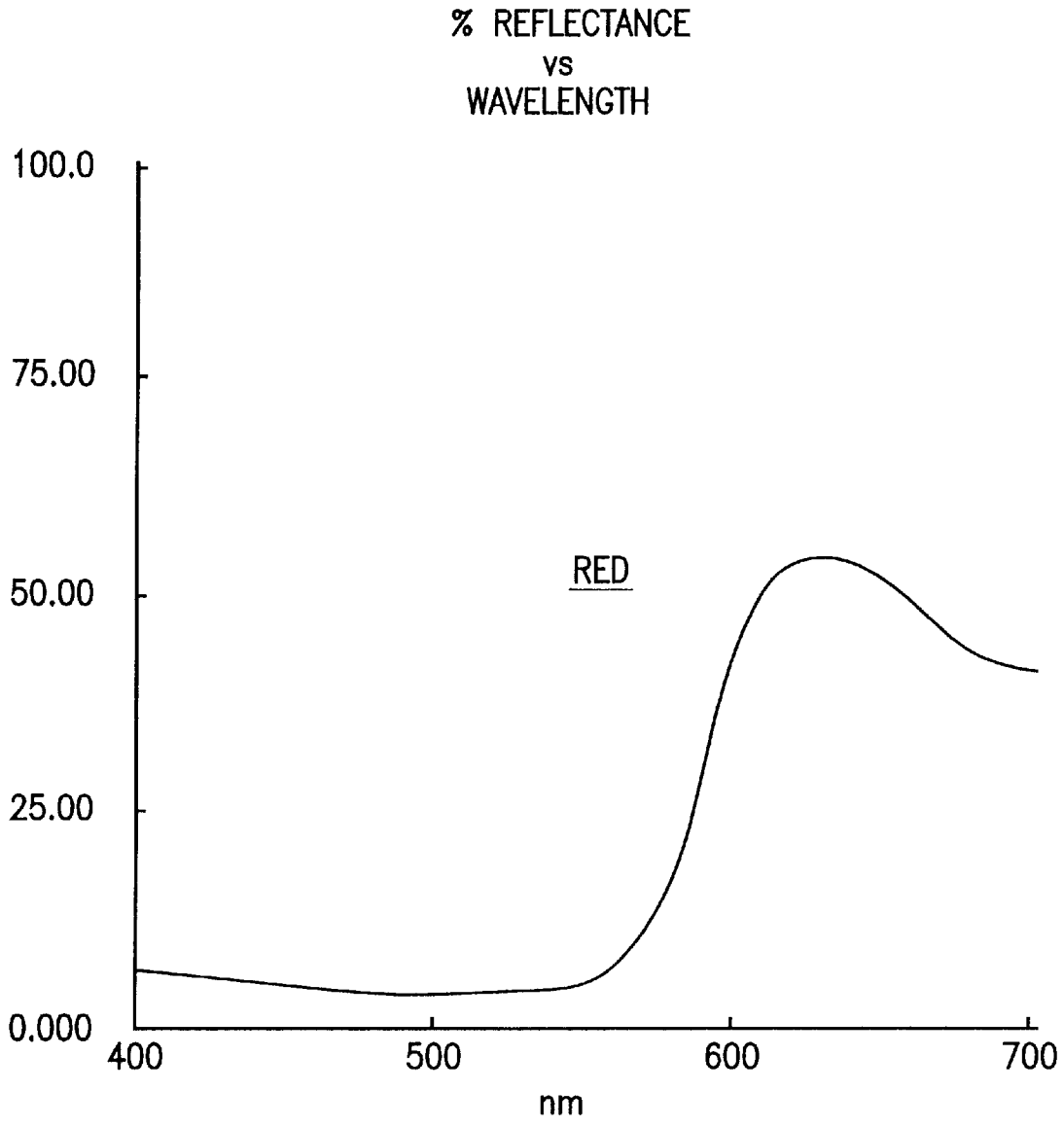
FIG. 11 shows the percent reflectance as a function of wavelength of a red diffuser according to the preferred embodiment of the present invention.

Referring to FIG. 11, the percent reflectance as a function of wavelength of a red diffuser 150 is shown. It is evident from FIG. 11 that the wavelength of the pigment of the diffuser 150 is matched to the wavelength of the red diffused LEDs 202*a*. It is preferred that the plastic material of the diffuser 150 have a florescent red pigment having the characteristics shown in FIG. 11 and that the specific density of the pigment be about 2% by weight (at about a 20/1 let-down ratio). Such pigmentation may be obtained from Color Technology, Inc. of Westboro, Mass. (Product No. D01866L2).

In accordance with an alternative embodiment of the invention, the diffuser 150 may include green pigment, which pigment has been color and density matched to the LED array as described above. In such an embodiment the LEDs may be of the green water clear type (i.e., having a wavelength of about 565 nm).

Figure 12:
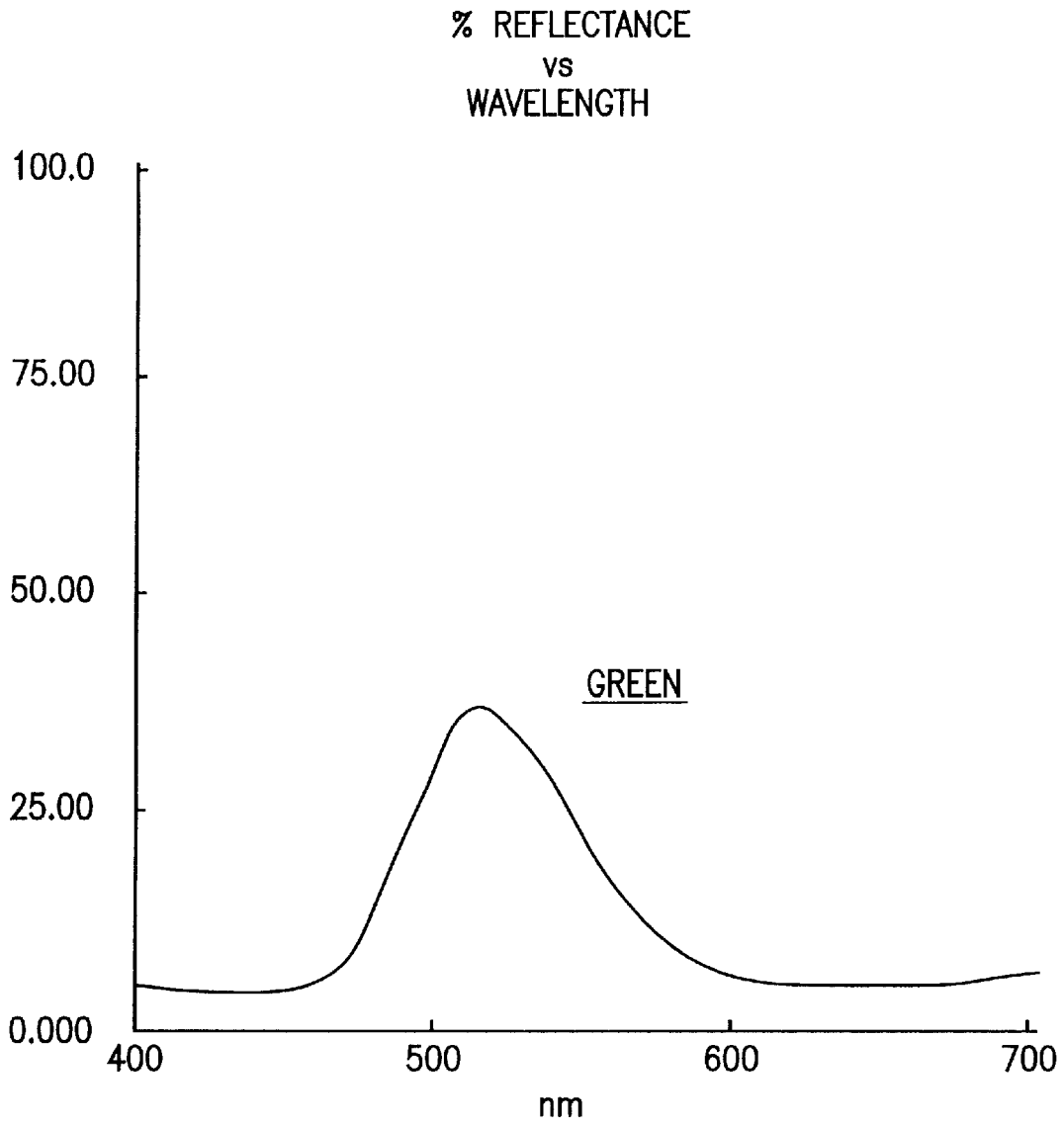
FIG. 12 shows the percent reflectance as a function of wavelength of a green diffuser according to an alternate embodiment of the present invention.

FIG. 12 shows the percent reflectance as a function of wavelength of a green diffuser 150. It is evident from FIG. 12 that the wavelength of the pigment of the green diffuser 150 may be matched to the wavelength of green diffused LEDs. It is preferred that the plastic material of a green diffuser 150 have a florescent green pigment having the characteristics shown in FIG. 12 and that the specific density of the pigment be about 1–2% by weight (at about a 20/1 let-down ratio). Such pigmentation may be obtained from Color Technology, Inc. of Westboro, Mass. (Product No. D01969L2).

Also in contrast to the diffusers of the prior art, the diffuser 150 of the present invention includes cut away portions 151, 152, and 153 which correspond to the indicia 111 of the front cover 110. With reference to FIGS. 4 and 6, the diffuser 150 is shown (in dashed lines) coupled to the front cover 110. The cut away portions 151, 152 and 153 permit light to reflect off of the inside of the front cover 110 and eventually propagate through the indicia 111.

Advantageously, the diffuser 150 of the present invention increases the intensity of light emerging from the indicia 111 because without the cut away portions 151, 152 and 153 light energy would be absorbed and attenuated in those areas of the diffuser 150.

It is noted that the diffuser 150 is ultrasonically bonded to the front cover 110 to reduce manufacturing costs. In keeping, ribs 160 are included on the diffuser 150 to channel an ultrasonic wave thereby focusing the wave for improved bonding action.

Turning back to FIG. 2, the LED array 202 consists of high intensity LEDs (i.e., having a high lumen output) which may be purchased from the Kingbright Company. It is most preferred that twenty LEDs be utilized in the array 202; however, any number of LEDs may be used and still be within the scope of the invention.

According to one aspect of the invention, LEDs of the red diffused type 202*a* (i.e, LEDs having a wavelength of about 660 nm at peak emission) are used in the array 202. It is noted that the red diffused LEDs 202*a* emit light in a generally diffused fashion, typically at an angle of between about 0° and 30° from vertical. It has been found that the use of high intensity diffused LEDs 202*a* in the LED array 202 improves the propagation of light through the indicia 111 and minimizes hot spots. Thus, unlike prior art signs, the internally illuminated sign 10 of this embodiment of the present invention does not require complex and costly reflector plates positioned to direct light from a unidirectional light source through the indicia 111.

It is preferred, however, that certain LEDs in the array 202 be of the red water clear type 202*b* which have a wavelength of about 660 nm at peak output. It is noted that the red water clear type LEDs 202*b* emit light in a generally unidirectional fashion (typically at an angle of between about 0° and 30° from vertical). It has been found that by placing water clear LEDs 202*b* in certain locations, improved illumination of the sign 10 is obtained. In particular, when water clear LEDs 202*b* are placed in the four locations indicated in FIG. 2, improved illumination of, for example, the chevrons 112 are obtained. This is so because the generally unidirectional emission of light from the water clear LEDs 202*b* reflects off of the top wall 104 and then out the chevrons 112 of the sign 10.

It has been found that the placement of the PCB 200 vis-a-vis the top wall 104 and the side walls 102 has a substantial affect on the light intensity and diffusion of the light out the indicia 111. In addition to the perpendicular orientation of the PCB 200 mentioned above, the distance of the PCB 200 from the top wall 104 and the angle of the jots 102*b* of the side walls 102 must be adjusted to maximize the diffusion and intensity of the light emanating from the sign 10.

The diffusion and intensity of the light (flux per unit area) emitted as a function of the distance of the LED array 200 from the top wall 104 and the angle of the jots 102*b* can be maximized when the distance of the PCB from the top wall 104 is about 6½ inches, the distance between the side walls 102 be about 10½ inches, and the angle of the jots 102*b* be about 25° from vertical.

It is noted that the LED array 202 may be mounted along the top wall 104 of the body 100 if the jots 102*b* and vertically extending portions 102*a* are reversed. Accordingly, the internally illuminated sign of the preferred embodiment of the present invention, utilizing the bottom or top mounted LED array 202 does not require complex and costly reflector plates or the like as do prior art signs.

Figure 10:
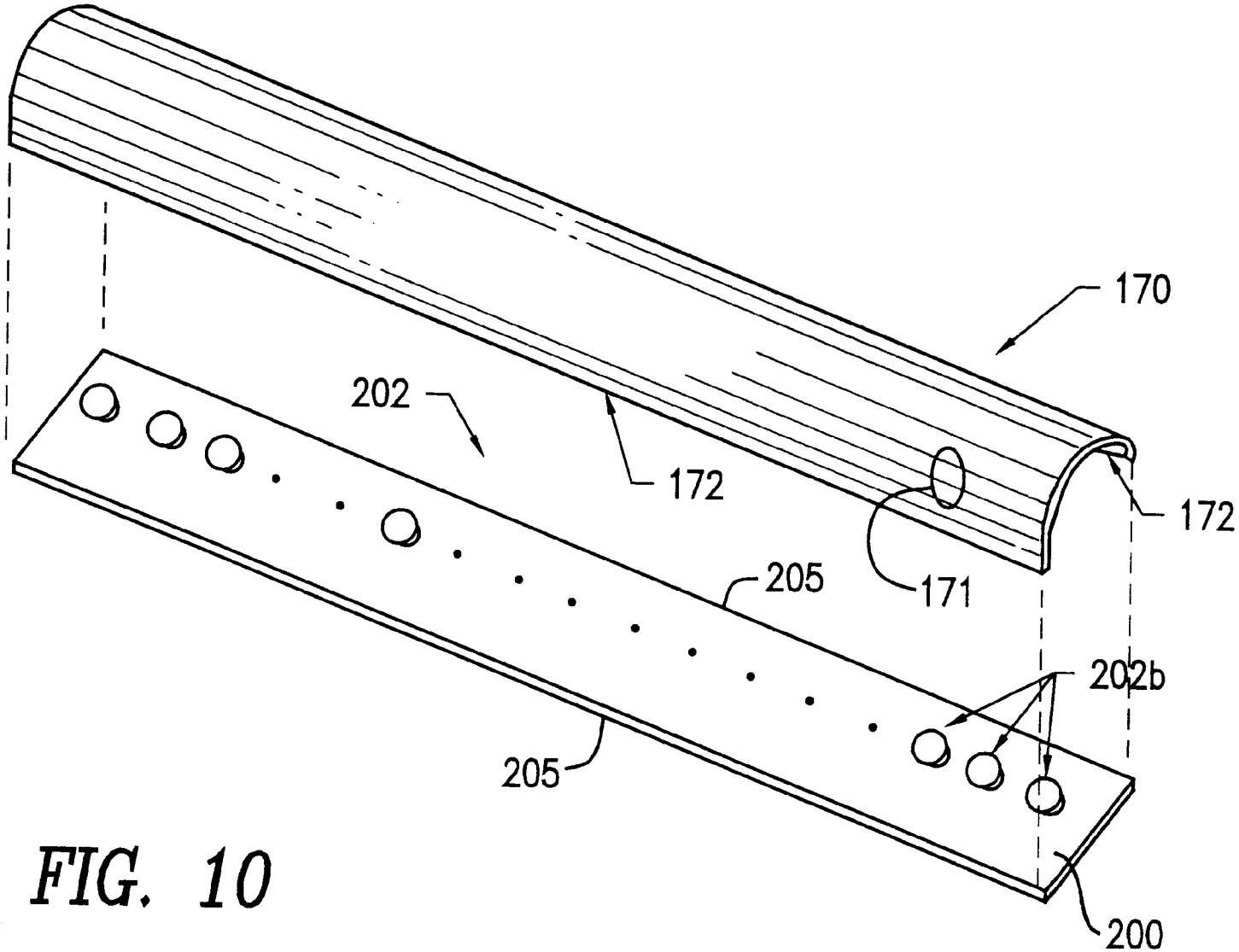
FIG. 10 shows a perspective view of an LED array according to still another embodiment of the present invention.

Reference is now made to FIG. 10 which shows an alternate embodiment of the LED array 202 of the present invention. The array 202 includes a plurality of LEDs mounted in spaced apart relationship as in other embodiments. However, in accordance with this embodiment of the invention, substantially all of the LEDs 202*b* are of the water clear type, for example, red water clear or green water clear.

The array 202 is substantially covered by an array diffuser 170 to improve the diffusion of the substantially unidirectional light emanating from the water clear LEDs 202*b*. The array diffuser 170 has a U-shaped cross section and includes longitudinal ribs 171 extending the length thereof to spread the light propagating therethrough. The array diffuser 170 is formed of a substantially transparent plastic material and is coupled, at its edges 172, to the edges 205 of the PCB 200.

Referring again to FIG. 2, in order to obtain battery backup capabilities, a battery 210 is disposed at the bottom of the body 100 adjacent the LED array 202. The battery 210 preferably includes four rechargeable NiCd cells totalling 4.8 VDC. The battery 210 is recharged via a recharging circuit (not shown) and sources energy to the LEDs when there is an emergency as is known in the art.

Advantageously, the selection of LED types, the placement and orientation of the LED array 202, and the use of the color matched and cut away diffuser 150 has improved the power efficiency of the sign 10. In particular, the above features permit operation of the LEDs at a correspondingly lower current level (without compromising the lumen output of the sign 10) which translates into a lower amp-hour requirement from the battery 210. Thus, it has been found that only a 4.8 VDC battery 210 (as opposed to a higher voltage battery, for example 6 VDC) is needed to exceed the emergency lumen and time requirements of UL 924.

Figure 8:
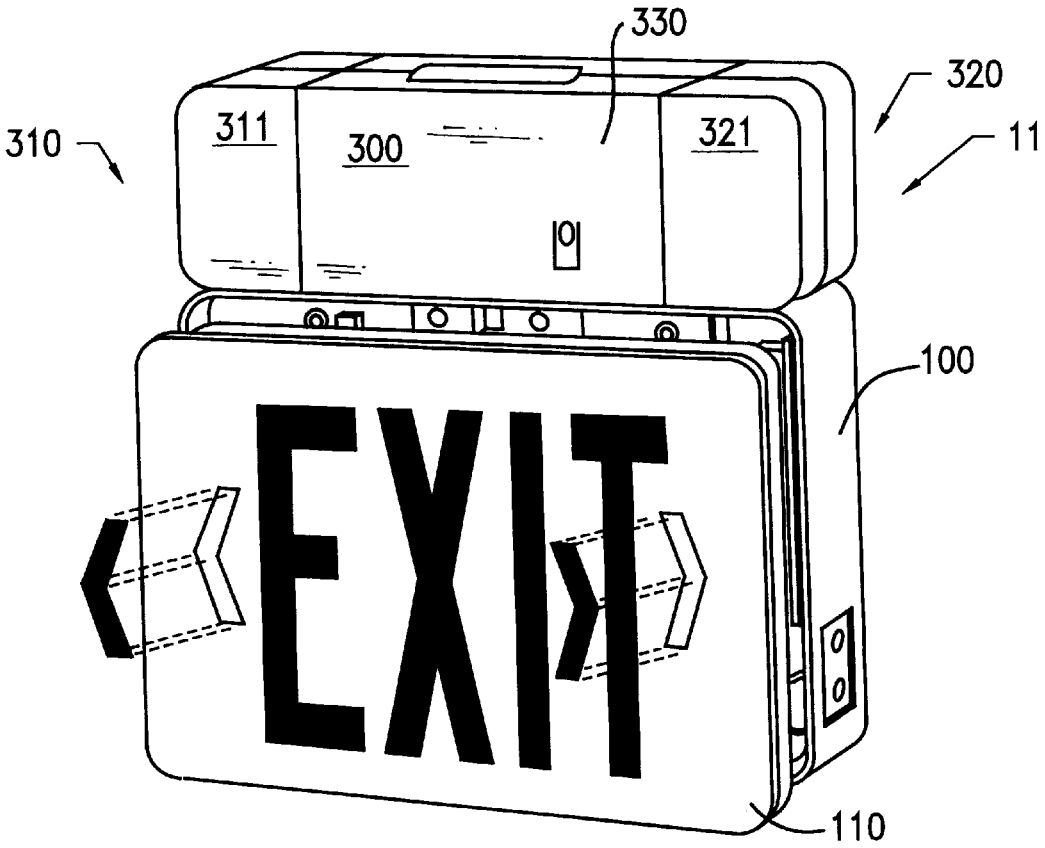
FIG. 8 shows a partially exploded perspective view of another embodiment of the internally illuminated sign of the present invention having an integrally mounted lighting unit.

Reference is now made to FIG. 8 which shows a perspective view of a second embodiment of an internally illuminated sign 11 of the present invention. The sign 11 is substantially similar to the internally illuminated sign 10 as described above except that it also includes an incandescent lighting unit 300 mounted to the top of the body 100. The incandescent lighting unit 300 includes first and second light sources 310, 320 and a power and control unit 330.

The lighting unit 300 provides adjustable incandescent spot lighting in an emergency situation and also powers the LED array 202 of the internally illuminated sign 11. Therefore, a separate backup battery 210 is not required in the second embodiment of the internally illuminated sign 11.

Each lighting unit 310 and 320 includes a translucent lens cover 311 and 321, respectively, which generally focuses the incandescent light and can direct the light, for example, in a downward direction. As will be discussed in more detail below, the lighting units 310 and 320 are designed to provide a user with additional options regarding the directivity of the incandescent lighting.

Figure 9:
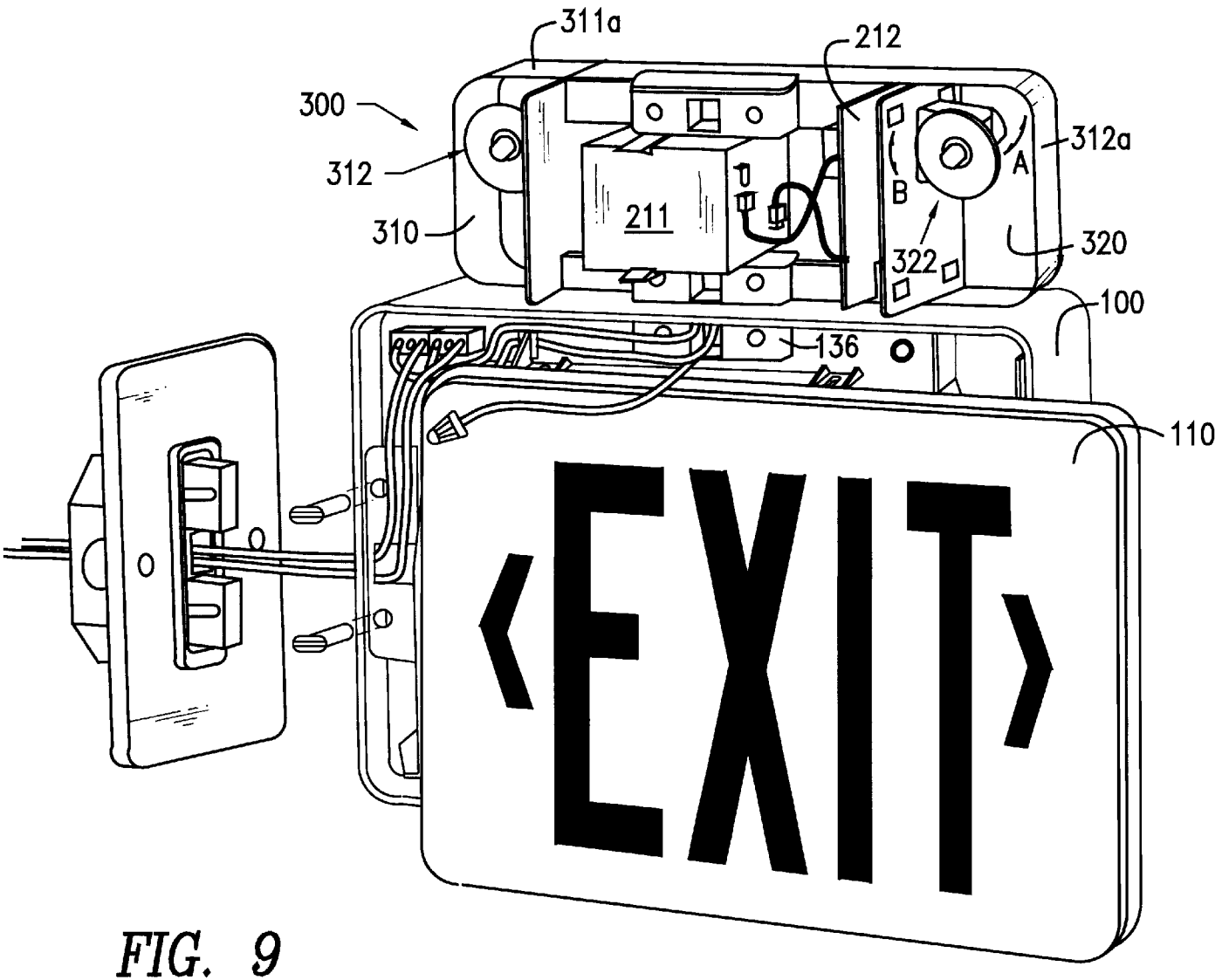
FIG. 9 shows a partially exploded perspective view of the internally illuminated sign of FIG. 8 with the front cover of the lighting unit removed.

Referring to FIG. 9, the internally illuminated sign 11 is shown with the front cover 110 partially removed, the lens covers 311 and 321 removed, and the power and control unit 330 exposed. The lighting unit 300 is mounted to the body 100 using a canopy receptacle 136 and nails 138 as described above. Further, the internally illuminated sign 11 may be mounted to the structure of a building in the same fashion as described above (i.e., side or bottom mounted). It is noted that if the lighting unit 300 is mounted to the bottom of the body 100, then the sign 11 may be side or top mounted to the structure of the building. Thus, the internally illuminated sign 11 of the present invention provides exceptional mounting versatility.

Each light source 310 and 320 also includes a gimbal type light head 312 and 322, respectively. The heads 312, 322 are adjustable in two directions, for example, a first direction shown by arrow A and a second direction shown by arrow B. Thus, particularly hazardous areas may be illuminated during an emergency situation by directing the light heads 312, 322 as needed.

The lighting unit 300 also includes substantially translucent lens covers 311*a* and 321*a* which cooperate with lens covers 311 and 321 to form enclosures which seal the adjustable light heads 312 and 322 therein. Advantageously, the light heads 312, 322 may be directed in substantially any direction. Further, because the heads 312, 322 are sealed in the lighting sources 310, 320, tampering is mitigated and safety is assured.

During an emergency, the lighting unit 300 is powered by a backup battery 211, preferably of the rechargeable 6 VDC sealed lead type, which battery 211 is recharged during normal operation by a control circuit 212. The battery 211 also powers the LED array 202 (not shown) in emergency situations.

Although the present invention has been described in relation to particular embodiments thereof, many other variations and modifications and other uses will become apparent to those skilled in the art. It is preferred, therefore, that the present invention not be limited by the specific disclosure herein.

What is claimed is:

1. An internally illuminated sign, comprising:

a body having a top, two spaced apart sides, and a bottom, the top, sides and bottom having inside and outside surfaces, the inside surfaces defining a cavity;

a front cover having an inside surface, an outside surface, and cut out portions extending through the cover forming indicia, the cover being operatively coupled to the body and substantially closing a front part of the cavity;

a rear cover operatively coupled to the body opposite the front cover and substantially closing a rear part of the cavity;

a light source disposed within the cavity; and a diffuser coupled to the cover and at least partially covering the indicia, the diffuser having cut away portions formed within a perimeter of the diffuser for permitting light from the light source to reflect off of the inside surface of the front cover, the cut away portions being sized and shaped to substantially conform to edges of the cut out portions of the indicia.

2. The internally illuminated sign of claim 1, wherein the diffuser is formed from one integral piece of material to cover the cut out portions of the indicia.

3. The internally illuminated sign of claim 1, wherein the diffuser is formed of injection moldable plastic.

4. The internally illuminated sign of claim 1, wherein the diffuser is ultrasonically bonded to the inside surface of the front cover.

5. The internally illuminated sign of claim 4, wherein the diffuser includes ribs which channel an ultrasonic wave for improved bonding action.

6. The internally illuminated sign of claim 1, wherein the diffuser has pigment therein and therethrough, which pigment has a color which is substantially matched to to the wavelength of the light from the light source.

7. The internally illuminated sign of claim 6, wherein the light source is an LED array.

8. The internally illuminated sign of claim 7, wherein the LEDs of the LED array are diffused LEDs.

9. The internally illuminated sign of claim 8, wherein the LEDs of the LED array are red diffused LEDs.

10. The internally illuminated sign of claim 9, wherein the LEDs of the LED array are red diffused LEDs having a wavelength of about 660 nm.

11. The internally illuminated sign of claim 6, wherein the pigment is a substantially red color to match the wavelength of a red diffused LED.

12. The internally illuminated sign of claim 11, wherein the pigment is a florescent red color to match the wavelength of a red diffused LED having a wavelength of about 660 nm.

13. The internally illuminated sign of claim 6, wherein the pigment is a substantially green color to match the wavelength of a green LED.

14. The internally illuminated sign of claim 13, wherein the pigment is a florescent green color to match the wavelength of a green LED having a wavelength of about 565 nm.

15. The internally illuminated sign of claim 6, wherein the diffuser includes pigment therein and the density thereof is selected to maximize the intensity of light emanating from the indicia.

16. The internally illuminated sign of claim 6, wherein the density of the pigment is about 1–2% by weight.

17. The internally illuminated sign of claim 1, further comprising an emergency lighting unit coupled to the body, and fitted within a dimension of the body, the lighting unit including at least one adjustable incandescent light source for illuminating an area around the sign.

18. The internally illuminated sign of claim 17 wherein the incandescent light source includes a first adjustable light head which is rotatably adjustable about a first axis.

19. The internally illuminated sign of claim 18, wherein the first adjustable light head is further rotatably adjustable about a second axis.

20. The internally illuminated sign of claim 19, wherein the first axis is perpendicular to the second axis.

21. The internally illuminated sign of claim 17, wherein the incandescent light source includes a second adjustable light head which is rotatably adjustable about a third axis.

22. The internally illuminated sign of claim 21, wherein the second adjustable light head is further rotatably adjustable about a fourth axis.

23. The internally illuminated sign of claim 22, wherein the third axis is perpendicular to the fourth axis.

24. The internally illuminated sign of claim 18, wherein the first adjustable light head is disposed within a substantially transparent enclosure, the enclosure including a lens for directing light emanating from the light head.

25. The internally illuminated sign of claim 24, wherein the enclosure including two substantially transparent removable enclosure halves.

26. The internally illuminated sign of claim 17, wherein the emergency lighting unit further includes a backup battery for providing power to the incandescent light source and the LED array.

27. The internally illuminated sign of claim 1, wherein the sign is adapted to mount to a electrical junction box, the internally illuminated sign further comprising:

a canopy including a base coupled to the junction box and at least one extension portion stretching away from the base and having at least a second nail hole therein, the extension portion operatively engaging the walls of the canopy receptacle such that the first and second holes correspond; and at least one canopy nail operatively engaging the first and second nail holes such that the canopy is fixed to the body.

28. The internally illuminated sign of claim 27, wherein the canopy nail includes a grip portion, a shaft extending from the grip portion, the shaft being insertable in the nail holes.

29. The internally illuminated sign of claim 28, wherein the canopy nail further includes a detent ring disposed on the shaft such that the detent ring operatively engages at least one of the nail holes.

30. The internally illuminated sign of claim 27, wherein the canopy includes two extension portions stretching away from the base, each extension portion including a nail hole therethrough for cooperating with corresponding holes in the canopy receptacle.

31. The internally illuminated sign of claim 17 wherein the emergency lighting unit is coupled to the body within the width dimension of the body.

32. The internally illuminated sign of claim 17 wherein the emergency lighting unit is coupled to the body within the height dimension of the body.

33. The internally illuminated sign of claim 17, wherein the emergency lighting unit is detachably coupled to the body.

34. The internally illuminated sign of claim 33, wherein the emergency lighting unit includes a power source to power the emergency lighting unit when detached from the body.

35. The internally illuminated sign of claim 33, wherein the lighting unit is detachably coupled to the body using a canopy system.

36. The internally illuminated sign of claim 35, wherein the canopy system comprises:

a canopy receptacle disposed in at least one of the top, bottom and sides of the body, the canopy receptacle formed by spaced apart walls debauching at the body, wherein at least a first nail hole extends through one of the walls;

a canopy including a base coupled to the lighting unit and at least one extension portion stretching away from the base and having at least a second nail hole therein, the extension portion operatively engaging the walls of the canopy receptacle such that the first and second holes correspond; and at least one canopy nail operatively engaging the first and second nail holes such that the canopy is fixed to the body.

37. An internally illuminated sign, comprising:

a body having a top, two spaced apart sides, and a bottom, the top, sides and bottom having inside and outside surfaces, the inside surfaces defining a cavity;

a front cover having an inside surface, an outside surface, and cut out portions extending through the cover forming indica, the cover being operatively coupled to the body and substantially closing a front part of the cavity;

a rear cover operatively coupled to the body opposite the front cover and substantially closing a rear part of the cavity; and a light source disposed within the cavity, the light source including an array of LEDs, wherein at least one of the LEDs is a diffused type LED and at least one of the LEDs is a unidirectional type LED.

38. The internally illuminated sign of claim 37, wherein the diffused LEDs of the LED array are red diffused LEDs and the substantially unidirectional LEDs are red water clear LEDs.

39. The internally illuminated sign of claim 36, wherein the red diffused LEDs have a wavelength of about 660 nm and the substantially unidirectional LEDs have a wavelength of about 660 nm.

40. The internally illuminated sign of claim 38, wherein the LED array includes 16 red diffused LEDs and 4 substantially unidirectional LEDs.

41. The internally illuminated sign of claim 37, wherein the LEDs of the LED array are mounted, in a perpendicular orientation, on a printed circuit board.

42. The internally illuminated sign of claim 41, wherein the printed circuit board is oriented in a perpendicular orientation with respect to the front cover.

43. The internally illuminated sign of claim 42, wherein the printed circuit board is operatively coupled to the bottom inside surface of the body.

44. The internally illuminated sign of claim 42, wherein the printed circuit board is operatively coupled to the top inside surface of the body.

45. The internally illuminated sign of claim 43, wherein the distance between the top inside surface of the body and the printed circuit board is predetermined to maximize the light emanating from the indicia.

46. The internally illuminated sign of claim 37, further comprising an array diffuser coupled to the light source to diffuse the light of the LEDs.

47. The internally illuminated sign of claim 46, wherein the LEDs of the array are mounted on a printed circuit board, the array diffuser being operatively coupled to the printed circuit board for diffusing the unidirectional light.

48. The internally illuminated sign of claim 46, wherein the array diffuser substantially covers all of the LEDs.

49. The internally illuminated sign of claim 46, wherein the LEDs of the array are green LEDs.

50. The internally illuminated sign of claim 49, wherein the LEDs of the LED array are green LEDs having a wavelength of about 565 nm.

51. The internally illuminated sign of claim 46, wherein the array diffuser has a U-shaped cross section and includes longitudinal ribs to diffuse the light propagating therethrough.

52. An internally illuminated sign, comprising:

a body having a top, two spaced apart sides, and a bottom, the top, sides and bottom having inside and outside surfaces, the inside surfaces defining a cavity;

a front cover having an inside surface, an outside surface, and cut out portions extending through the cover forming indica, the cover being operatively coupled to the body and substantially closing a front part of the cavity;

a rear cover operatively coupled to the body opposite the front cover and substantially closing a rear part of the cavity; and a light source disposed within the cavity, the light source including an array of LEDs, wherein at least one of the LEDs is a diffused type LED and at least one of the LEDs is a water clear type LED.

53. The internally illuminated sign of claim 52, wherein the diffused LEDs of the LED array are red diffused LEDs and the substantially water clear LEDs are red water clear LEDs.

54. The internally illuminated sign of claim 53, wherein the red diffused LEDs have a wavelength of about 660 nm and the substantially water clear LEDs have a wavelength of about 660 nm.

55. The internally illuminated sign of claim 53, wherein the LED array includes 16 red diffused LEDs and 4 substantially water clear LEDs.

56. The internally illuminated sign of claim 52, wherein the LEDs of the LED array are mounted, in a perpendicular orientation, on a printed circuit board.

57. The internally illuminated sign of claim 56, wherein the printed circuit board is oriented in a perpendicular orientation with respect to the front cover.

58. The internally illuminated sign of claim 57, wherein the printed circuit board is operatively coupled to the bottom inside surface of the body.

59. The internally illuminated sign of claim 57, wherein the printed circuit board is operatively coupled to the top inside surface of the body.

60. The internally illuminated sign of claim 58, wherein the distance between the top inside surface of the body and the printed circuit board is predetermined to maximize the light emanating from the indicia.

* * * * *